US005707953A

United States Patent [19]

Van't Land et al.

[11] Patent Number: 5,707,953

[45] Date of Patent: Jan. 13, 1998

[54] FLUIDIZED BED COATED AMIDOPEROXYACID BLEACH COMPOSITION

[75] Inventors: Cornelis Marinus Van't Land, Enschede; Johannes Gerhardus Bernardus Bouwmeester, Zutphen; Cornelis Kooijman; Charles Frederik Hansfort Manuhutu, both of Deventer; Jan Joseph Hubert Ploumen, Roermond, all of Netherlands

[73] Assignee: Akzo Nobel N.V., Arnhem, Netherlands

[21] Appl. No.: 537,710

[22] PCT Filed: Apr. 2, 1994

[86] PCT No.: PCT/EP94/01046

§ 371 Date: Jan. 26, 1996

§ 102(e) Date: Jan. 26, 1996

[87] PCT Pub. No.: WO94/24260

PCT Pub. Date: Oct. 27, 1994

[30] Foreign Application Priority Data

Apr. 19, 1993 [EP] European Pat. Off. ..... 93201124

[51] Int. Cl.[6] ..... C11D 17/00

[52] U.S. Cl. ..... 510/375; 252/186.25; 252/186.26; 252/188.1; 427/213

[58] Field of Search ..... 252/186.25, 186.26, 252/188.1; 510/375; 427/213

[56] References Cited

U.S. PATENT DOCUMENTS

| | | | |
|---|---|---|---|
| 3,494,787 | 2/1970 | Lund et al. | 117/100 |
| 3,936,537 | 2/1976 | Baskervill et al. | 427/242 |
| 3,950,275 | 4/1976 | Toyoda et al. | 252/527 |
| 3,989,635 | 11/1976 | Toyoda et al. | 252/135 |
| 4,105,827 | 8/1978 | Brichard et al. | 428/403 |
| 4,126,573 | 11/1978 | Johnston | 252/99 |
| 4,134,850 | 1/1979 | McCrudden | 8/111.5 |
| 4,634,551 | 1/1987 | Burns et al. | 252/102 |
| 4,681,695 | 7/1987 | Dive | 252/186.25 |
| 4,686,063 | 8/1987 | Burns | 252/102 |
| 4,818,425 | 4/1989 | Meijer | 252/186.26 |
| 4,997,590 | 3/1991 | Bowling | 252/186 |
| 5,049,298 | 9/1991 | Ploumen et al. | 252/95 |
| 5,055,218 | 10/1991 | Getty et al. | 252/94 |

FOREIGN PATENT DOCUMENTS

| | | | |
|---|---|---|---|
| 0 254 331 | 1/1988 | European Pat. Off. | C11D 3/39 |
| 0 349 220 A2 | 1/1990 | European Pat. Off. | C11D 3/39 |
| 0 376 360 | 7/1990 | European Pat. Off. | C11D 3/395 |
| 0 435 379 A3 | 7/1991 | European Pat. Off. | C11D 3/39 |
| 2 229 768 | 12/1974 | France | C11D 3/40 |
| 24 43 073 | 3/1975 | Germany | C11D 1/00 |
| 1 476 682 | 6/1977 | United Kingdom | D06L 3/02 |
| 2 032 421 | 5/1980 | United Kingdom | C07C 179/10 |
| WO 91/16411 | 10/1991 | WIPO . | |
| WO 92/08780 | 5/1992 | WIPO . | |

OTHER PUBLICATIONS

*Cake Formation in Particulate Systems,* Edward J. Griffith, p. 78 (1991).

*Primary Examiner*—Margaret Einsmann

*Attorney, Agent, or Firm*—Ralph J. Mancini; Louis A. Morris

[57] ABSTRACT

A coated bleach composition for laundering which contains from 1–97 weight percent of an amidoperoxyacid, and 0–98 weight percent of a hydratable amidoperoxyacid compatible material, less than 2.0 weight percent of water, and a coating of 2–30 weight percent of a water-soluble salt applied by spray coating on a fluidized bed, is disclosed.

Also disclosed is a process for the coating of an amidoperoxyacid-containing bleach composition characterized by the steps of spraying, at a temperature below the decomposition temperature of the amidoperoxyacid, a sufficient amount of an atomized spray of an aqueous solution of a water-soluble salt onto a fluidized bed of bleach composition containing an amidoperoxyacid to provide 2–30 weight percent of the water-soluble salt to the composition, and drying the coated composition to a water content of less than 2.0 weight percent. The coating of the composition eliminates caking problems encountered with the uncoated composition.

12 Claims, No Drawings

FLUIDIZED BED COATED AMIDOPEROXYACID BLEACH COMPOSITION

The present invention relates to a coated bleach composition containing amidoperoxyacid which composition has been spray coated in a fluidized bed with a coating of a water-soluble salt. The present invention also relates to a coating process for application of the coating to the bleach composition.

Amidoperoxyacid bleach granules are known from U.S. Pat. No. 5,055,218. These granules generally contain 5–70 weight percent of amidoperoxyacid, 1–40 weight percent of a surfactant and 10–95 weight percent of a hydratable material. These granules are said to have a good dissolution rate in wash liquor, a good solution stability and are compatible with dry, granular detergents to make a bleach detergent composition. This patent publication does not mention caking of the granules.

The present inventors have found that the granules of U.S. Pat. No. 5,055,218 suffer from a significant caking problem, i.e. the granules tend to stick together upon storage or application of pressure as in, for example, large transportation containers. Accordingly, there is a need for a solution to this caking problem in order to facilitate the storage and transport of such amidoperoxyacid bleach granules.

Caking has been recognized as a problem for granular detergents in U.S. Pat. No. 3,950,275, for example, where it is proposed to coat the detergent granules with a builder such as anhydrous sodium sulfate, sodium tripolyphosphate, and sodium carbonate among others. The coating is performed by a known method such as using a drum granulator (example 1). The examples demonstrate a reduction in caking for these detergent granules when coated. No mention is made of the coating of peroxy-containing bleach granules in this publication.

Another patent relating to the caking of detergent granules is U.S. Pat. No. 3,989,635 which proposes to spray a coating agent selected from aqueous solutions of alkali metal silicates, carbonates and hydroxides either alone or in combination with a powder of alkali metal silicates, sulfates, carbonates and hydroxides. The coating may be accomplished in a revolving drum, a revolving cross drum or a fluidized tower, all of which methods are deemed equivalent. Again, it is not suggested to coat peroxy-containing bleach granules.

In addition, U.S. Pat. No. 4,997,590 discloses the spray coating of extruded bleach activator compositions with an aqueous solution of a water-soluble dye and a water-soluble hydratable material such as sodium sulfate. This spray coating is carried out in a drum granulator with the objective of colouring the bleach activator compositions. The use of $Na_2SO_4$ reduces agglomeration of the particles and promotes even colouring. Although the coating process of this patent reduces cake strength for the first 30 minutes after the coating, after 24 hours uncoated particles exhibit a better cake strength than coated particles. Accordingly, this process is not suited to prevent caking during storage and transport of the particles.

British patent specification 1,476,682 and U.S. Pat. No. 3,494,787 both propose the coating of aliphatic, alicyclic and aromatic peroxyacids to reduce or prevent decomposition of the peroxyacid and to provide exotherm control should decomposition occur. The preferred peroxyacid is perphthalic acid. Among the coating agents employed are the alkali metal sulfates and alkaline earth metal sulfates.

The coatings are applied by forming a fluidized bed of the sulfate coating material and feeding preformed peroxyacid particles to the fluidized bed. These publications do not mention caking.

However, British patent application 2,032,421 notes that coatings formed by the process disclosed in the above two patent specifications are not continuous, are very expensive and that the coated compositions tended to cake. Accordingly, this publication leads one of skill in the art away from the process suggested by the above two patent specifications when faced with a caking problem. Instead of the fluidized bed process, GB 2,032,421 advocates simply mixing dry or moist peroxyacid with dry salts or in situ formation of the salt in the peroxyacid reaction mixture in order to reduce caking.

U.S. Pat. No. 4,105,827 remarks that coatings applied with the goal of stabilizing inorganic peroxygen compounds, such as sodium silicate or magnesium sulphate coatings, result in a partial tendency of the stored material to agglomerate (cake). As an alternative stability-enhancing coating, this patent proposes to use a mixed salt such as sodium sesquicarbonate or mixed compounds obtained by crystallization of sodium sulphate and sodium carbonate to coat alkali metal persalts in order to enhance their storage stability. This coating is preferably applied by spraying an aqueous solution of the coating material onto a fluidized bed of the alkali metal persalts in order to obtain a homogeneous coating. In comparative example 7, alkali metal persalt is coated with sodium sulphate by fluidized bed spraying. No data is given with respect to the caking of these materials.

U.S. Pat. No. 4,126,573 suggests the coating of solid peroxyacids with alkali metal salts of 9–22 carbon atom alkyl sulfates to enhance storage stability and provide exotherm control without negatively influencing the solubility of the peroxyacids in wash liquor. The preferred method of coating is the spraying of an aqueous solution of the coating material onto a fluidized bed of the solid peroxyacid. Again, no reference is made to caking in this patent.

Finally, European patent application 0 254 331 discloses a process for the production of shaped particles from agglomerates of diperoxydodecanedioic acid by coating the agglomerates with a hydratable material such as sodium sulphate. The coating is applied at a temperature above the hydration temperature of the hydratable material by mixing in, for example, an Eirich mixer, agglomerates, wet cake and anhydrous sodium sulphate. No data on the caking of these shaped particles is presented. The coating is applied to stabilize the agglomerates of diperoxydodecanedioic acid.

Accordingly, there is a need in the art for a reliable method to prevent the caking of amidoperoxyacid-containing compositions as well as for novel amidoperoxyacid-containing compositions which do not cake. These and other objects of the invention will be apparent from the detailed description which follows.

The present invention relates to a coated bleach composition for laundering characterized in that the coated composition comprises from 1–98 weight percent of an amidoperoxyacid represented by the formulas I–II:

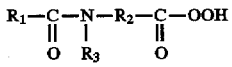

Formula I

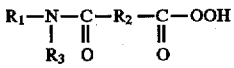

Formula II wherein $R^1$ and $R^2$ are alkyl(ene), aryl(ene) or alkaryl(ene) groups containing from about 1–14 carbon atoms, and $R^3$ is hydrogen or an alkyl, aryl or an aralkyl group containing from about 1 to about 10 carbon atoms; and 0–97 weight percent of an amidoperoxyacid compatible material; less than 2.0 weight percent of water; and a coating of 2–30 weight percent of a water-soluble salt which crystallizes quickly upon evaporation of water from a solution of the salt and which is applied by spray coating of the granules in a fluidized bed coating apparatus.

In a second embodiment, the present invention also relates to a process for the coating of an amidoperoxyacid-containing bleach composition characterized by the steps of spraying, at a temperature below the decomposition temperature of the amidoperoxyacid and above the adiabatic saturation temperature of the air/solution system, a sufficient amount of an atomized spray of an aqueous solution of a water-soluble salt onto a fluidized bed of bleach composition containing an amidoperoxyacid represented by the formulas I–II to provide 2–30 weight percent of the water-soluble salt to the bleach composition, and drying the coated composition to a water content of less than 2.0 weight percent.

DETAILED DESCRIPTION OF THE INVENTION

The present invention relates to coated compositions of amidoperoxyacids which are safe, have a low water content and do not suffer from caking and/or solubility problems. The present invention also provides a process for making said coated compositions.

Amidoperoxyacids are described in U.S. Pat. No. 4,634,551 and U.S. Pat. No. 4,686,063, both of which patents are incorporated by reference herein. The amidoperoxyacids comprised in the compositions of the present invention have the following general formulas I and II:

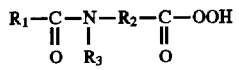

Formula I

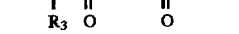

Formula II wherein $R^1$ and $R^2$ are alkyl(ene), aryl(ene) or alkaryl(ene) groups containing 1–14 carbon atoms, and $R^3$ is hydrogen or an alkyl, aryl or an aralkyl group containing 1 to 10 carbon atoms.

Preferred amidoperoxyacids are those of the general formula II wherein $R^3$=H, and $R^1$ is a $C_6$–$C_{12}$ alkyl group and $R^2$ is a $C_1$–$C_6$ alkylene group. Most preferred peracids are nonylamido peroxy adipic acid and nonylamido peroxy succinic acid. Synthesis methods for making the peracids are known from the two above-identified U.S. patents.

The compositions which are to be coated by the process of the present invention may be those obtained by a process as described in U.S. Pat. No. 5,049,298 and those described in U.S. Pat. No. 5,055,218. A typical granulation process comprises the following steps:

1. Contacting an amidoperoxyacid composition comprising: 10–80% water, and 20–90% amidoperoxyacid, with a dry feed stream of particulate solids which comprises an amidoperoxyacid compatible material,
2. forming wet granules from said mixture, and
3. drying said wet granules in an oven at about 40° C. until the weight is constant to thereby achieve a low final moisture content, to produce amidoperoxyacid-containing granules.

Alternatively, the compositions to be coated may be amidoperoxyacid containing compositions comprising substantially pure amidoperoxyacid or, amidoperoxyacid and other optional additives as mentioned below.

The moisture content of the composition has an influence on its caking properties as is known from, "Cake formation in Particulate Systems", Griffith, Edward J., Weinheim: VCH, p. 78, (1991). Accordingly, compositions having a moisture content of less than 2.0% by weight, are required. Moisture contents in the context of the present specification are to be determined by drying the composition in an oven at 40° C. until a constant weight is achieved and measuring the weight loss as a result of the oven-drying. 100% of the weight reduction is attributed to the moisture content.

Typical compositions to be coated in accordance with the present invention contain 1–99% of amidoperoxyacid, 0.25–10% by weight of a bleach-stable surfactant and 0–97 weight percent of amidoperoxyacid compatible material. More preferred compositions for coating in accordance with the present invention contain 30–60% of amidoperoxyacid, and 20–65% of compatible material. By compatible material is meant material which, when contacted with the amidoperoxyacid, does not significantly increase the decomposition rate thereof.

The amidoperoxyacid compatible material may be selected from materials such as sodium sulphate, sodium acetate, sodium perborate, zinc nitrate, magnesium sulphate, magnesium nitrate, sodium phosphate, sodium acid phosphite, lithium formate, lithium sulphate, sodium citrate, sodium tartrate, potassium aluminum sulphate, polymeric fillers such as polyethylene glycol and polyacrylates and mixtures thereof. Sodium sulphate is the most preferred amidoperoxyacid-compatible material.

Of course, several optional components may also be present in the amidoperoxyacid composition coated in the present invention. As examples of suitable additional materials which may be incorporated in the composition are surfactants, and more preferably, detergent surfactants.

The detergent surfactants can be any one or more surface active agents selected from anionic, nonionic, zwitterionic, amphoteric and cationic surfactants, and mixtures thereof. The surfactants useful in the present composition can be found in U.S. Pat. No. 4,686,063, the disclosure of which is hereby incorporated by reference.

Most preferred are the anionic surfactants such as the $C_{11}$–$C_{13}$ linear alkyl benzene sulfonates (LAS). This material is employed in an amount of 0.25–25% and more preferably 1–10% in said composition. The preferred surfactant is sodium dodecyl benzene sulfonate. In addition, sequestering or chelating agents may be used in amounts of 0.001 to 5% in order to take-up metal ion impurities which may be present in the composition.

The coating of the composition of the present invention makes up 2–30 weight percent of the total weight of the composition. More preferably, the coating makes up 4–15 weight percent of the weight of the composition, and, most preferably, 8–12% by weight.

Useful coating materials are water-soluble salts which crystallize quickly upon evaporation of water from a solution of such salt. More particularly, the water-soluble salts useful in the coating of the present invention include the phosphates, citrates, tartrates, acetates, sulphates and carbonates such as sodium monobasic phosphate, sodium dibasic phosphate, sodium sulfate, magnesium sulfate, magnesium ammonium sulfate, aluminum magnesium nitrate, potassium magnesium sulfate, potassium aluminum sulfate, ammonium aluminum sulfate, potassium sulfate, sodium nitrate, sodium carbonate, sodium citrate, sodium tartrate, sodium acetate and sodium aluminum sulfate. The most preferred water-soluble salt is sodium sulfate.

The coating of the present invention generally covers at least 30% of the surface of the composition. More preferred coatings substantially cover the entire surface of the composition. The most preferred coating of the present invention is characterized by having a substantially uniform surface and forms an essentially complete encapsulation of the entire surface of the amidoperoxyacid composition. The most preferred coating of the present invention has a density of 1500 to 3000 $Kg/m^3$.

Higher moisture contents, (up to 2.0% by weight), tend to result in increased caking. If a high moisture content is desired, then it must be compensated by a heavier coating.

It has surprisingly been found that such a coating substantially reduces caking of the amidoperoxyacid composition without significantly impairing its safety or solubility. In addition, the coating may reduce the tendency of the composition to cause skin irritation, and can potentially be colored or perfumed. Also, the coating potentially enhances the compatibility of the amidoperoxyacid composition with detergents.

The coated composition of the present invention can be used as bleaching compositions either alone or in combination with detergents. Thus the bleaching compositions can contain typical detergent composition components such as detergency builders. The usual components of detergent compositions are set forth in U.S. Pat. No. 3,936,537, incorporated herein by reference. Such components generally include color speckles, suds boosters, suds suppressors, antitarnish and/or anticorrosion agents, soil-suspending agents, soil-release agents, dyes, fillers, optical brighteners, germicides, alkalinity sources, hydrotropes, antioxidants, enzymes, enzyme stabilizing agents, perfumes, etc. Useful detergency builders can also be found in U.S. Pat. No. 4,686,063. Any of these optional materials may also be incorporated in the coating of the present invention.

Finally, buffering agents may be employed to maintain the pH at a desirable level. Also, the phosphate buffer wash of European patent application 0 349 220 is preferably employed in order to enhance the chemical stability of the amidoperoxyacid in the coated composition.

The coating is applied by the coating process which is a second aspect of the present invention. More particularly, the amidoperoxyacid-containing bleach composition is coated by spraying an atomized spray of an aqueous solution of a water-soluble salt onto a fluidized bed of the bleach composition. Once coated, the composition is then dried to a water content of less than 2.0 weight percent.

In one embodiment where low temperatures are to be employed, the aqueous solution of water-soluble salt preferably contains slightly less water-soluble salt than would be required for a saturated solution. In this manner, unwanted precipitation of the water-soluble salt in the lines and fluid bed can be minimized or avoided. For example, rather than employing a saturated solution of sodium sulfate (about 30% sodium sulfate by weight at 30° C.), a 20% solution is employed to thereby significantly reduce the risk of uncontrolled precipitation of the sodium sulfate out of solution during the coating process.

In a second embodiment, it is preferred to employ a saturated solution of water-soluble salt or a slurry since this leads to energy savings in the drying process and can lead to cost savings in equipment. An example of a slurry is a saturated sodium sulfate solution containing additional crystalline sodium sulfate having a particle size of less than about 1 μm. Up to 60–70% total solids could be employed.

Sufficient aqueous solution of water-soluble salt is employed to provide 2–30 weight percent of water-soluble salt as a coating on the amidoperoxyacid composition. More preferably, the feed of water-soluble salt is regulated to provide a coating making up 4–15 weight percent of the coated composition, and, most preferably, 8–12% by weight.

The fluid bed coating process must be carried out at a temperature below the decomposition temperature of the amidoperoxyacid. In addition, the coating process must be carried out at a temperature above the adiabatic saturation temperature of the air/solution system. The coating process must also be carried out above 0° C. to avoid freezing problems. Room temperature or just above may be a convenient temperature for the coating process. The temperature is preferably controlled by adjusting the flow rate and temperature of the fluidizing air and the flow and temperature of the aqueous coating solution.

In an alternative embodiment, the coating process is carried out using a hydratable, water-soluble salt and in such a way that both the aqueous solution of water-soluble salt and the fluidized bed of amidoperoxyacid composition are maintained at a temperature at which the water-soluble salt in its solid form does not carry water of hydration. For example, when coating with sodium sulfate it is preferred to coat the composition at a temperature above the hydration temperature of sodium sulfate, namely, 32.4° C.

The most preferred composition to be coated in the coating process is an amidoperoxyacid granule composition where the granules are of a uniform and relatively small size(e.g. 1 mm). These particles are best suited for the fluidized bed coating process.

The coating may contain minor amounts of other ingredients besides the water-soluble salt such as sequestering agents, surfactants, buffers and other typical ingredients mentioned above for the bleach composition.

In the preferred coating apparatus, a two-fluid nozzle is employed so that the ratio of air to aqueous solution can be carefully varied in order to optimize the spraying process. In addition, the ratio of the feed rate of the aqueous solution of water-soluble salt to the fluidizing air flow influences the temperature of the fluidized bed.

The coated composition may be dried in any conventional manner. The preferred drying process is in a fluid bed dryer using air at about 40°–60° C. The residual moisture content of the coated composition should be reduced to below 2.0 weight percent in order to effectively prevent caking in accordance with the present invention. In the preferred process, coating and drying are carried out in the same fluid bed apparatus.

The following examples are presented for the purposes of illustration and description only and are not to be construed as limiting the invention in any way. The scope of the invention is to be determined from the claims appended hereto.

ANALYTICAL PROCEDURES EMPLOYED IN THE EXAMPLES

All percentages are percentages by weight, based on the weight of the total composition.

Total Active Oxygen Content

The total active oxygen content of the amidoperoxyacid compositions was determined by using the following analytical grade reagents:

0.1 N Sodium thiosulfate solution

Glacial acetic acid, and

10% w/w Potassium iodide solution.

To determine total active oxygen content, 600 mg. of the composition is placed in a stoppered flask. 60 ml of glacial acetic acid are added to dissolve the amidoperoxyacid. Then, 50 ml of water are added to dissolve the remaining solids in the sample. Nitrogen or carbon dioxide is passed over the sample for 2 minutes and the sample is retained in a nitrogen or carbon dioxide atmosphere. 10 ml of potassium iodide solution are added and the solution is allowed to stand in the dark for 5 minutes at about 25° C. Finally, the solution is titrated with the sodium thiosulphate solution to a colorless end point. The active oxygen content can then be calculated by reference to a titration of a blank solution.

Caking

Cake strength is measured by placing the material in a cylindrical cake test unit in a controlled atmosphere and applying pressure. After a storage time of 5–30 days, the load is removed and a force gauge is applied to determine the force required to begin the breaking of the cake.

A cake grade of 0.0 indicates that the stored material fell apart of its own accord, thus demonstrating no tendency to cake.

Solubility

Solubility is determined in accordance with the test of European patent application 376 360. More particularly, the dissolution time is measured by the neutralization rate of a dispersion of 150 mg of granulate in 150 ml water at 25° C. and a pH of 9.5, in which process the insoluble peracid was converted to its soluble neutralized salt. The neutralization process is followed by measuring the amount of a 0.1 N NaOH solution to be added to maintain a constant pH value of 9.5 with a Metrohm™ 632 pH measuring device. The dissolution time is defined as the time required for the neutralization of half of the amount employed.

EXAMPLES 1–10 AND COMPARATIVE EXAMPLES A–B

Elimination of Caking by Sodium Sulfate Coating

Granules containing 35% by weight of nonylamido peroxyadipic acid, 55.6% sodium sulfate, 3.5% linear sodium dodecyl benzene sulfonate, the balance of water, stabilizers and impurities, and having a water content below 2.0%, were coated batchwise in a fluid bed coating apparatus using a 20% w/w aqueous solution of sodium sulfate. The bed temperatures and quantities of sodium sulfate coating are given in Table 1 along with measurements of water content, density, and cake grade. The fluidized bed initially contained 150 grams of fluidized material.

Once coated, samples of the coated material were taken and dried by oven drying to analyse the residual moisture before performing the cake test.

TABLE 1

| | sulfate coating [%] | Bed temp. [°C.] | resid. moist. before Cake Test [%] | bulk density [g/cc] | cake [kg] | grade [lbs] | resid. moist. after Cake Test [%] |
|---|---|---|---|---|---|---|---|
| 1 | 3 | >32.4 | 0.06 | 0.66 | 6.35 | (14.0) | 0.32 |
| 2 | 5 | >32.4 | 0.13 | 0.66 | 1.45 | (3.2) | 0.24 |
| 3 | 6 | >32.4 | 0.03 | 0.66 | 0.36 | (0.8) | 0.14 |
| 4 | 7 | >32.4 | 0.23 | 0.66 | 0.00 | (0.0) | 0.28 |
| 5 | 8 | >32.4 | 0.09 | 0.68 | 0.00 | (0.0) | 0.18 |
| 6 | 8 | >32.4 | 0.20 | 0.69 | 0.00 | (0.0) | 0.27 |
| A | 8 | >32.4 | 0.77 | 0.68 | 14.33 | (31.6) | 0.67 |
| B | 16 | >32.4 | — | 0.71 | 9.07 | (20.0) | 1.04 |

TABLE 1-continued

| | sulfate coating [%] | Bed temp. [°C.] | resid. moist. before Cake Test [%] | bulk density [g/cc] | cake [kg] | grade [lbs] | resid. moist. after Cake Test [%] |
|---|---|---|---|---|---|---|---|
| 7 | 11 | >32.4 | 0.11 | 0.68 | 0.00 | (0.0) | 0.21 |
| 8 | 12 | >32.4 | — | 0.71 | 0.00 | (0.0) | 0.32 |
| 9 | 20 | >32.4 | — | 0.77 | 0.00 | (0.0) | 0.31 |
| 10 | 3 | <32.4 | 0.12 | 0.66 | 8.16 | (18.0) | 0.32 |
| 11 | 7 | <32.4 | 0.13 | 0.68 | 7.44 | (16.4) | 0.26 |
| 12 | 8 | <32.4 | 0.18 | 0.68 | 4.08 | (9.0) | 0.24 |

The caking values of Table 1 show that with coatings of 3% or more of sodium sulfate, caking was significantly reduced and with coatings above 7% no tendency for caking was found (with bed temperature >32.4° C.).

COMPARATIVE EXAMPLES C–J

In these examples, the uncoated granule of Example 1 was tested for caking at several different moisture contents. From these examples it was determined that the caking problem could not be solved simply by a thorough drying of the granule. All uncoated granules exhibited a severe caking problem as can be seen from Table 2.

TABLE 2

| Example | resid. moist before Cake Test [%] | density [g/cc] | cake grade [kg] | cake grade [lbs] | resid. moist. after Cake Test [%] |
|---|---|---|---|---|---|
| C | — | 0.69 | 14.51 | (32.0) | 0.48 |
| D | 0.37 | 0.65 | 14.97 | (33.0) | 0.38 |
| E | 0.42 | 0.65 | 19.05 | (42.0) | 0.45 |
| F | 0.4Z | 0.65 | 16.69 | (3&.8) | 0.48 |
| G | 0.45 | 0.65 | 16.42 | (36.2) | 0.49 |
| H | 0.11 | 0.65 | 13.88 | (30.6) | 0.29 |
| I | 0.00 | 0.64 | 14.70 | (32.4) | 0.21 |
| J | 0.40 | 0.61 | 17.87 | (39.4) | 0.51 |

EXAMPLES 13–18 AND COMPARATIVE EXAMPLE K

In these examples it is demonstrated that coatings of at least 4.5% by weight of sodium sulfate significantly reduce the caking problem whereas with coatings of 7.5% by weight no tendency for caking was found. The granule of Example 1 was coated by the method of Example 1 and all coatings were applied at a bed temperature in excess of 32.4° C. The results are given in Table 3. These tests were scaled up in comparison to example 1 and thus employed fluidized beds having initially 3,250 grams instead of 150 grams of material.

TABLE 3

| Example | Active Oxygen [%] | Sodium Sulfate Coating [%] | Bulk density [kg/m³] | resid. moist. before Cake Test [%] | cake [kg] | grade [lbs] | resid. moist. after Cake Test [%] |
|---|---|---|---|---|---|---|---|
| K | 1.938 | 0.0 | 650 | 0.44 | 14.51 | (32.0) | 0.49 |
| 13 | 1.787 | 7.8 | 700 | 0.32 | 0.00 | (0.0) | 0.34 |
| 14 | 1.790 | 7.6 | 690 | 0.24 | 0.00 | (0.0) | 0.30 |
| 15 | 1.785 | 7.9 | 690 | 0.28 | 0.00 | (0.0) | 0.33 |
| 16 | 1.850 | 4.5 | 660 | 0.13 | 7.26 | (16.0) | 0.21 |
| 17 | 1.787 | 7.8 | 700 | 0.30 | 0.00 | (0.0) | 0.36 |
| 18 | 1.793 | 7.5 | 700 | 0.21 | 0.00 | (0.0) | 0.33 |

COMPARATIVE EXAMPLES L–U

In these examples it is shown that coating using a drum granulator and/or an Eirich mixer does not solve the caking problem.

For comparative examples L–R, the following procedure was employed in order to simulate the coating process suggested in Example 1 of U.S. Pat. No. 3,950,275. and the coating process taught in U.S. Pat. No. 4,997,590. More particularly, an Erweka drum granulator was filled with the granules of example 1 and rotated slowly. The granules were then wetted with water taking care not to add too much water to cause caking in the granulator. The quantity of sodium sulfate specified in Table 4 was then carefully dosed while rotating the granulator, mixing was continued until the components were thoroughly mixed and then the coated granules were removed from the drum granulator and dried to a moisture content below 0.5% by weight. In examples M, O and Q an oven was used for drying while examples N, P and R were dried in a fluid bed dryer.

Comparative examples S–U were done by filling an Eirich mixer with the granules of Example 1 and allowing the mixer to rotate slowly. For example T, the temperature was raised to 40°–45° C. and the amount of sodium sulfate given in Table 4 was carefully dosed to the mixer and allowed to mix until a substantially homogeneous mixture was achieved. The mixture was then sprayed with a limited amount of water without caking the material and, after several minutes of additional mixing, the coated granules were removed from the mixer and dried in a fluid bed dryer. For example U the temperature was first raised to 40°–45° C., then water was sprayed on and finally the sodium sulfate was dosed to the mixer. For experiments T and U, drying proved difficult and the water content of these coated granules after drying was 1.2 and 1.7%, respectively.

The results of these comparative experiments are given in Table 4.

TABLE 4

| Example | $Na_2SO_4$ [%] | Active Oxygen [%] | Bulk Density [kg/m³] | Cake grade [kg] | Cake grade [lbs] |
|---|---|---|---|---|---|
| L | 0 | 1.94 | 650 | >13.61 | (>30) |
| M | 8 | 1.94 | 670 | >13.61 | (>30) |
| N | 8 | 1.94 | 670 | >>13.61 | (>>30) |
| O | 10 | 1.94 | 680 | 12.70 | (28) |
| P | 10 | 1.93 | 680 | >13.61 | (>30) |
| Q | 15 | 1.94 | 690 | >13.61 | (>30) |
| R | 15 | 1.94 | 690 | >>13.61 | (>>30) |
| S | 0 | 1.94 | 650 | >13.61 | (>30) |
| T | 15 | 1.91 | 750 | >>13.61 | (>>30) |
| U | 15 | 1.85 | 780 | >>13.61 | (>>30) |

Notable in these experiments was that some of the sodium sulfate was found as a thin layer in the drum granulator. Additional sodium sulfate was lost during fluid-bed drying as indicated by a film of sodium sulfate on the dryer filter.

EXAMPLES 19–25 AND COMPARATIVE EXAMPLES V–Y

In these examples the granule of example 1 was coated with varying amounts of sodium sulfate at different temperatures as given in Table 5. The solubility was measured in accordance with the procedure given above and the results are also presented in Table 5. From these results it can be seen that the coating has little or no negative influence on the solubility of the granules.

TABLE 5

| Example | Coating $Na_2SO_4$ [%] | Coating temp. [°C.] | NAPAA [% core] | Solubility of 50% [seconds] |
|---|---|---|---|---|
| V | — | — | 35 | 12 |
| 19 | 3 | <32.4 | 35 | 12 |
| 20 | 7 | <32.4 | 35 | 12 |
| 21 | 8 | <32.4 | 35 | 12 |
| 22 | 3 | >32.4 | 35 | 18 |
| 23 | 5 | >32.4 | 35 | 12 |
| 24 | 6 | >32.4 | 35 | 12 |
| 25 | 7 | >32.4 | 35 | 12 |
| W | — | — | 35 | 12 |
| X | — | — | 40 | 12 |
| Y | — | — | 49 | 12 |

EXAMPLE 26 AND COMPARATIVE EXAMPLE Z

The flow properties of the coated NAPAA granules were compared to the flow properties of uncoated NAPAA granules. In particular, a variety of tests were performed with regard to the flow patterns and for handling of the materials in different types of flow bins and feeders. Further, the flow properties of the materials were determined after five days storage at rest in simulated railcar storage conditions.

The test results indicate that the coated NAPAA granules of the present invention show a significant improvement in overall flow properties when compared to uncoated NAPAA granules.

The foregoing examples have been presented for purposes of illustration and description only and are not to be construed as limiting the scope of the invention in any manner. Accordingly, the scope of the invention is to be determined by the claims appended hereto.

What is claimed is:

1. A coated bleach composition for laundering having a reduced tendency to cake wherein the coated composition comprises:

(a) from 1–99 weight percent of an amidoperoxyacid represented by the formulas I–II:

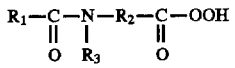

Formula I

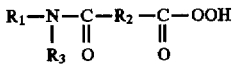

Formula II wherein $R^1$ and $R^2$ are alkyl(ene), aryl(ene) or alkaryl (ene) groups containing 1–14 carbon atoms, and $R^3$ is hydrogen or an alkyl, aryl or an aralkyl group containing 1 to 10 carbon atoms;

(b) 0–97 weight percent of an amidoperoxyacid compatible material;

(c) less than 2.0 weight percent of water; and a coating of 2–30 weight percent of a water-soluble salt which has been applied by spraying onto a fluidized bed of bleach composition.

2. The coated bleach composition of claim 1 which further comprises 0.25–10 weight percent of a bleach stable surfactant selected from anionics, nonionics, ampholytics, zwitterionics or combination thereof.

3. The coated bleach composition of claim 1 wherein the coating comprises 4–15 weight percent of the composition.

4. The coated bleach composition of claim 1 wherein the water-soluble salt is a salt selected from sodium monobasic phosphate, sodium dibasic phosphate, sodium sulfate, magnesium sulfate, magnesium ammonium sulfate, aluminum magnesium nitrate, potassium magnesium sulfate, potassium aluminum sulfate, ammonium aluminum sulfate, potassium sulfate, sodium nitrate, sodium carbonate, sodium citrate, sodium tartrate, sodium acetate, sodium aluminum sulfate, or mixtures thereof.

5. The coated bleach composition of claim 1 wherein the amidoperoxyacid is nonyl amido peroxy adipic acid and the water-soluble salt is sodium sulfate.

6. A process for the coating of an amidoperoxyacid-containing bleach composition which comprises:

(a) spraying, at a bed temperature below the decomposition temperature of the amidoperoxyacid and above the adiabatic saturation temperature of the air/solution system, a sufficient amount of an atomized spray of an aqueous solution of a water-soluble salt onto a fluidized bed of bleach composition containing from 1–99 weight percent of an amidoperoxyacid represented by the formulas I–II:

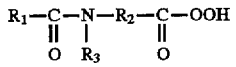

Formula I

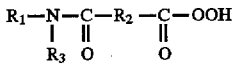

Formula II wherein $R^1$ and $R^2$ are alkyl(ene), aryl(ene) or alkaryl (ene) groups containing 1–14 carbon atoms, and $R^3$ is hydrogen or an alkyl, aryl or an aralkyl group containing 1 to 10 carbon atoms; to provide 2–30 weight percent of water-soluble salt to the composition and (b) drying the coated composition to a water content of less than 2.0 weight percent.

7. The process of claim 6 wherein the aqueous solution of the water-soluble salt is not saturated.

8. The process of claim 6 wherein the water-soluble salt is a hydratable salt, during the spraying step, the fluidized bed is maintained at a temperature at which the hydratable water-soluble salt in its solid form does not carry water of hydration.

9. The process of claim 6 wherein 4–15 weight percent of water-soluble salt is provided to the composition in the spraying step.

10. The process of claim 6 wherein a two-fluid spray nozzle is employed to spray the aqueous solution of water-soluble salt.

11. The process of claim 6 wherein the water-soluble salt is sodium sulfate and the amidoperoxyacid is nonyl amido peroxy adipic acid.

12. The process of claim 6 wherein the drying step is carried out using warm fluidizing air.

* * * * *